United States Patent [19]

Bodinger et al.

[11] 4,068,411

[45] Jan. 17, 1978

[54] DOOR TRACK CONSTRUCTION

[75] Inventors: Donald C. Bodinger, Portage; Paul A. Tombers, Merrillville; Richard C. Snyder, Michigan City, all of Ind.

[73] Assignee: Pullman Incorporated, Chicago, Ill.

[21] Appl. No.: 760,046

[22] Filed: Jan. 17, 1977

[51] Int. Cl.[2] ..... E06B 7/14

[52] U.S. Cl. ..... 49/408; 49/412

[58] Field of Search ..... 49/411, 410, 408, 412, 49/235, 426, 427, 220, 217, 219; 16/94 R

[56] References Cited

U.S. PATENT DOCUMENTS

| | | | |
|---|---|---|---|
| 1,114,000 | 10/1914 | Jones | 49/412 |
| 2,415,731 | 2/1947 | Ditchfield | 49/412 X |
| 2,447,846 | 8/1948 | Ditchfield | 49/426 X |
| 2,494,467 | 1/1950 | Beauchamp | 49/426 X |
| 2,824,339 | 2/1958 | Shaver | 49/410 |

*Primary Examiner*—Philip C. Kannan

*Attorney, Agent, or Firm*—Thomas G. Anderson

[57] ABSTRACT

A box car door track support includes a continuous structural support member which is supported on the side sill of the car beneath the door opening. A track is mounted on the continuous track support and a plurality of spaced gussets reinforce the support structure.

7 Claims, 3 Drawing Figures

DOOR TRACK CONSTRUCTION

BACKGROUND OF THE INVENTION

1. Field of the Invention

The present invention relates to railway freight cars and in particular to freight car door track structures.

2. Description of the Prior Art

During cargo loading and unloading operations, freight car door track structures are continually bumped or jarred by the cargo as well as the cargo loading or material handling equipment. As a result the door track may become bent or dented such that it obstructs opening and closing of the car door.

The prior art door track structures are exemplified by U.S. Pat. Nos. 2,415,731; 2,447,846; and 2,824,339. U.S. Pat. Nos. 2,415,731 and 2,447,846 disclose door track structures intended to prevent the entry of direct or reflected light and foreign matter upwardly into the car through the door openings; and, U.S. Pat. No. 2,824,339 shows a sliding box car door carried on a door track supported from a side sill reinforcement through a series of longitudinally spaced gusset plates. None, however, disclose the novel door track construction of the present invention which essentially eliminates obstructive distortion or loosening of the door track as well as providing a light and weather shielding structure which is easily fabricated and inexpensive to repair or replace during the service life of the car.

SUMMARY OF THE INVENTION

The present invention relates to an impact dissipating and light shielding door track construction for a railway freight car. The door track construction includes a door supporting track portion which is in turn supported from a reinforcing channel of the side sill of the car by a generally Z-shaped bracket which is coextensive with the door track and includes a depending inboard portion abutting and secured to the reinforcing channel by rivets or the like. Thus the invention provides for a relatively integral structural connection between the door track and the car which assures uniform distribution of local bumps or crushing loads on the door track throughout the entire track construction and in turn into the reinforcing member. Additionally and as will become evident from the foregoing description and drawing the invention includes a set of baffles which serve to prevent direct or reflected light as well as foreign matter from entering the car when the door is in its closed position.

DESCRIPTION OF THE PREFERRED EMBODIMENT

Figure 1:
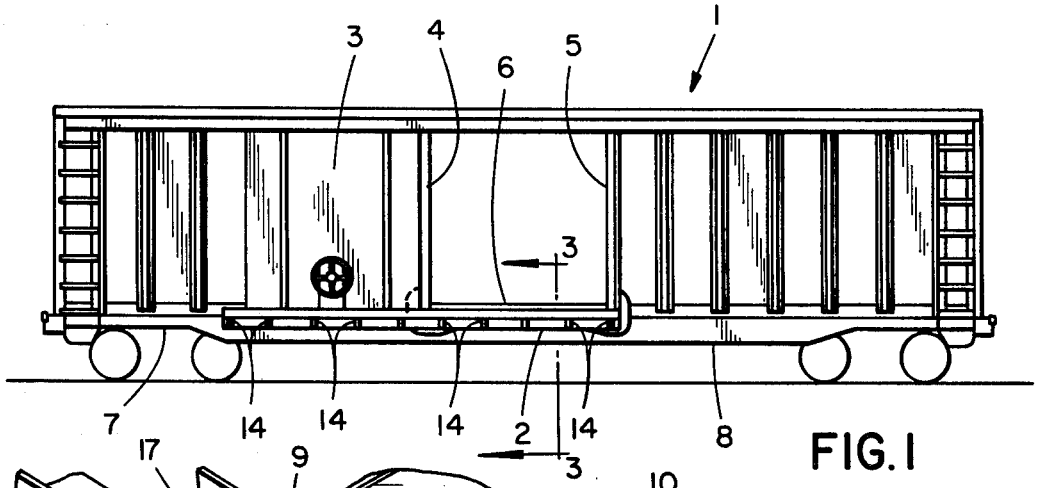
FIG. 1 is a side elevational view of a railway box car embodying the present invention.

Referring to the drawings there shown is a typical railway box car 1 incorporating the novel door track construction 2 of the present invention. As can be seen from FIG. 1 which shows the door 3 of the car moved to the fully opened position, the car includes door posts 4,5 defining the sides of the doorway or door opening 6 and longitudinally extending side sills 7 and associated reinforcing members 8 disposed on either side of the car in the usual manner. Similarly, the base of the doorway is defined by a threshold plate or member 9 coplanar with the car floor 10 which is carried on the side sill 7 and channel member 11.

Figure 2:
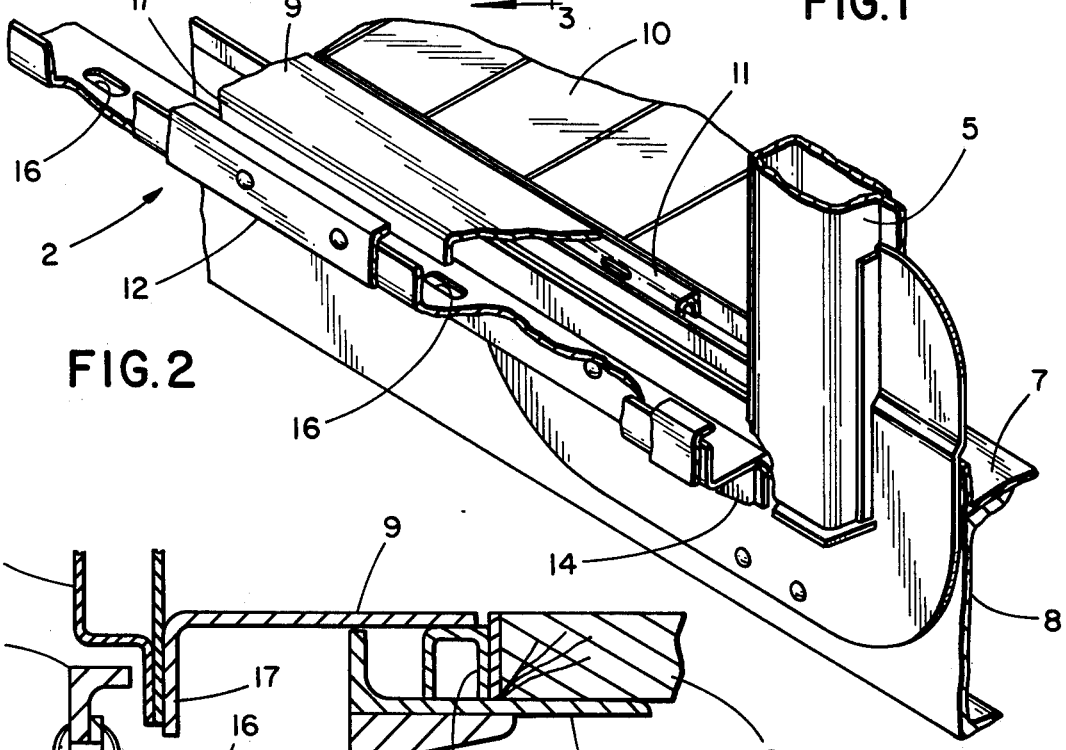
FIG. 2 is a perspective sectional view of the invention.
Figure 3:
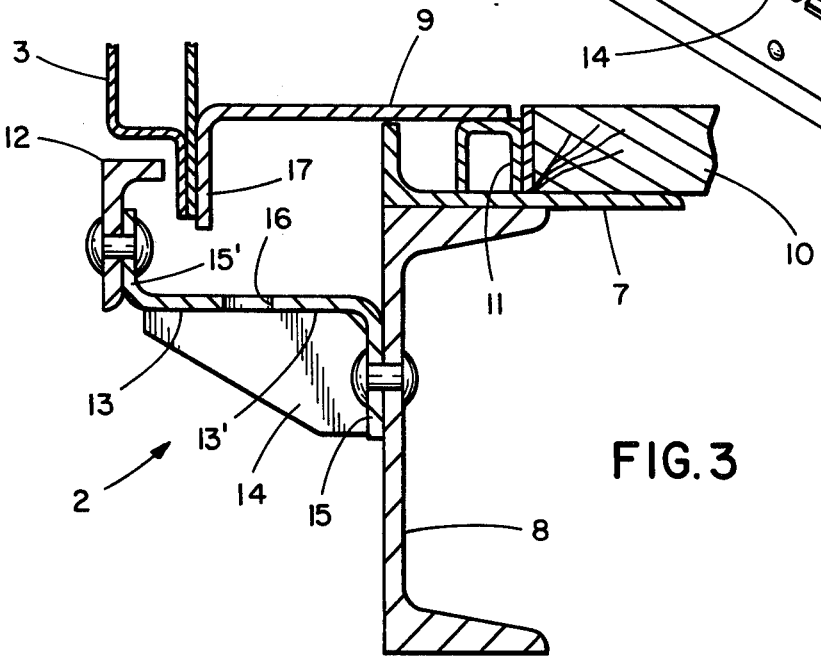
FIG. 3 is a cross-sectional view taken along line 3—3 in FIG. 1.

As can be seen from FIGS. 2 and 3 the light shielding door track construction 2 includes an inverted L-shaped door track 12 supportably secured to a Z-shaped bracket or track support 13 cantilevered outwardly from the reinforcing member 8 and riveted or otherwise appropriately secured thereto. The track support 13 includes a downwardly extending inner flange 15 and an upwardly extending outer flange 15'. A horizontal web 13' connects said flanges 15 and 15'. To additionally reinforce and support the brackets 13, a plurality of longitudinally spaced gusset plates 14 are supportably secured beneath and to the bracket and the flange 15; however, it should be noted that since the downwardly extending flange 15 of the bracket 13 abuts the reinforcing member 8 throughout and coextensive with the width of the doorway 6, the bracket 13 and reinforcing member 8 cooperate to form a relatively integral door track load transferring member such that localized stress concentrations and the like in the bracket are essentially eliminated. This is particularly important since by distributing sharp or harsh loads on the track caused when a cargo crate is dropped on the track or the track is bumped by handling equipment when the car is being loaded or unloaded, the present construction obivates the possibility of the track being bent or twisted such that it obstructs or jams the door.

To facilitate drainage, the present bracket construction 13 is provided with a plurality of holes or slots 16 in the web 13'. To maintain the light shielding feature of the present construction, the holes 16 are spaced inboard of the base of the door 3 and the depending threshold flange 17 to baffle direct or reflected light as well as foreign matter and thus prevent its entry upwardly into the car.

The door 3 is not described in detail and is conventional in prior art constructions as shown in the patents of the prior art. Generally when the door is stationary it is frictionally supported on the door track construction but includes anti-friction means for facilitating sliding of the door 3 between open and closed positions.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A railway box car having a wall including a door opening, a side sill construction below said door opening including a longitudinally extending side sill, a floor supported on said side sill, a threshold plate supported on and projecting outwardly from said side sill, a door supported on said car for sliding movement between open and closed positions relative to said door opening, the improvement of a door track construction positioned below said door comprising;

a track support including bracket means having a continuous horizontal web member extending the width of said door opening, and to one side thereof, means connecting an inner side of said web member to said side sill, a door track coextensive with said web member, means connecting an outer side of said web member to said track said track member having an upper inwardly extending door supporting surface, and a plurality of gusset members supported on said side sill and connected to said web members substantially throughout the length thereof.

2. The invention in accordance with claim 1, said means connecting the inner side of said web member to said side wall including a downwardly extending flange on said web member, said means connecting the outer side of said web member to said track including an upwardly extending flange.

3. The invention in accordance with claim 2, said web member having a plurality of vertically extending longitudinally spaced openings.

4. The invention in accordance with claim 3, said opening being spaced laterally inwardly with respect to outwardmost extension of said threshold plate.

5. The invention in accordance with claim 4, said threshold plate having a depending flange at its outward-most extension.

6. The invention in accordance with claim 5, said openings comprising elongated slots.

7. The invention in accordance with claim 5, said depending flange of said threshold plate having an inner vertical surface spaced substantially outwardly of said openings.

* * * * *